US007487725B2

(12) United States Patent
Koppelkamm

(10) Patent No.: US 7,487,725 B2
(45) Date of Patent: Feb. 10, 2009

(54) METHOD AND APPARATUS FOR SECURING A PRINTING PLATE ON A PLATE CYLINDER

(75) Inventor: Guenter Koppelkamm, Neuensalz (DE)

(73) Assignee: Man Roland Druckmaschinen AG, Augsburg (DE)

( * ) Notice: Subject to any disclaimer, the term of this patent is extended or adjusted under 35 U.S.C. 154(b) by 364 days.

(21) Appl. No.: 11/335,265

(22) Filed: Jan. 19, 2006

(65) Prior Publication Data

US 2006/0169158 A1 Aug. 3, 2006

(30) Foreign Application Priority Data

Jan. 20, 2005 (DE) ..... 10 2005 002 684

(51) Int. Cl.
*B41F 27/12* (2006.01)

(52) U.S. Cl. ..... 101/415.1; 101/378

(58) Field of Classification Search ..... 101/415.1, 101/378

See application file for complete search history.

(56) References Cited

U.S. PATENT DOCUMENTS

| | | | | |
|---|---|---|---|---|
| 2,965,025 | A * | 12/1960 | Mueller | 101/415.1 |
| 3,362,327 | A * | 1/1968 | Luehrs | 101/415.1 |
| 4,347,788 | A * | 9/1982 | Dufour et al. | 101/415.1 |
| 5,284,093 | A * | 2/1994 | Guaraldi et al. | 101/415.1 |
| 5,359,933 | A * | 11/1994 | Blaser et al. | 101/415.1 |
| 5,738,012 | A * | 4/1998 | Metrope | 101/415.1 |
| 2004/0237819 | A1* | 12/2004 | Koppelkamm | 101/415.1 |

FOREIGN PATENT DOCUMENTS

| | | | |
|---|---|---|---|
| DE | 199 24 786 | A1 | 12/2000 |
| DE | 102 55 707 | A1 | 6/2004 |
| EP | 0 713 770 | A1 | 5/1996 |
| EP | 1 291 175 | A1 | 3/2003 |
| EP | 1 481 803 | A1 | 12/2004 |

* cited by examiner

*Primary Examiner*—Leslie J Evanisko
(74) *Attorney, Agent, or Firm*—Crowell & Moring LLP

(57) ABSTRACT

A method and apparatus for securing a printing plate on a plate cylinder is disclosed. A tensioning bar is moved by an actuating device toward an entrance slot defined by an outer circumferential edge of the cylinder to engage a rear end of the printing plate. The tensioning bar is disposed on a profile body disposed within a channel defined by the cylinder and extending parallel to an axis of the cylinder. The actuating device is disposed in the profile body. The tensioning bar is then moved away from the entrance slot by the actuating device to exert a tensioning force on the rear end of the printing plate.

25 Claims, 2 Drawing Sheets

METHOD AND APPARATUS FOR SECURING A PRINTING PLATE ON A PLATE CYLINDER

This application claims the priority of German Patent Document No. 10 2005 002 684.2, filed Jan. 20, 2005, the disclosure of which is expressly incorporated by reference herein.

BACKGROUND AND SUMMARY OF THE INVENTION

The present invention relates to a plate cylinder for a web-fed printing press having a device for securing flexible printing plates provided with bent ends mountable on the circumference, an installation channel accessible through an entrance slot on the circumference being provided, the channel being limited on one side of its input area by a wedge-shaped lip edge on one side for engaging the front ends of the plates and at least one profile body being secured therein, having at least one holding device that can be engaged with the rear end of at least one printing plate.

An arrangement of this type is known from German Patent Document DE 102 55 707 A1. The holding device assigned to the rear ends of the plates is formed there only as a clamping mechanism which is unable to execute any chucking movement. However, this has proven to be a disadvantage in many cases.

Against this background, the object of the present invention is therefore to improve upon a device of the generic type with simple and inexpensive means so that a reliable chucking force can be applied to the rear ends of the plates.

This object is achieved according to this invention by the fact that the holding device assigned to the rear ends of the plates includes a tension strip that is accommodated on the profile body and is moveable toward the entrance slot and away from it and an actuating device installed in the profile body and assigned to the former, the actuating consisting of a lifting mechanism and a return mechanism that counteracts this, whereby the tension strip can be engaged by means of the lifting mechanism in an assembly position approaching the entrance slot, in which position the rear end of each assigned printing plate can be engaged on a suspension claw on the tension strip and can be brought into tension engagement with the rear end of each respective printing plate by means of the return mechanism.

These measures yield a mounting device having a high level of safety and reliability. At the same time, these measures ensure such a compact arrangement that despite the use of a displaceable tensioning bar, the complete mounting device assigned to the rear ends of the plates is situated on the profile body. The inventive arrangement therefore makes due with only one cylinder recess assigned to the profile body per mounting device in an advantageous manner, the cylinder recess practically forming a joint design space for the tensioning bar and the lifting and restoring mechanisms assigned thereto. Multiple design spaces and thus multiple cylinder recesses are not necessary in a advantageous manner. Therefore an inadmissible weakening of the cylinder can be avoided easily. Another advantage of the measures according to the present invention may be regarded as the fact that despite permitting a reliable plate tension, a comparatively narrow input cross section of the cylinder recess is possible, i.e., a comparatively narrow interruption in the circumference of the cylinder. This ensures that as a rule no bearer rings are needed, and furthermore, excitation of the inking rollers to vibration is largely suppressed.

At least one clamping spring adjacent to the tensioning bar may advantageously be provided on a profile body, the clamping spring coming to rest against the inside flank of the lip edge assigned to the front ends of the plates. This clamping of the front ends of the plates increases reliability. The clamping springs provided for this purpose also advantageously eliminate the need for clamping with the help of a tensioning bar, which would in principle also be possible, so that the lift of the latter may also be comparatively small, which has an advantageous effect on the compact design that can be achieved. The great advantage deriving from a compact design can be further increased by the fact that the profile body has a cutout facing the tensioning bar and optionally the clamping spring in the circumferential area facing the entrance slot.

In another refinement of the primary measures, the profile body may have a channel assigned to the actuating mechanism of the tensioning bar, boreholes emanating from this channel so that tappets carrying the tensioning bar and cooperating with the actuating mechanism engage in these boreholes. The tappets may be guided in the boreholes, which permits a high degree of reliability. At the same time, these measures also allow the design space assigned to the actuating mechanism to be sealed with respect to the area of the installation channel that is open via the entrance slot, which in-turn results in reliable protection from damage and soiling.

A particularly comfortable embodiment of the lifting mechanism may consist of the latter having a lifting cushion that engages beneath the tappet and can be acted upon by a pressure means. Such an arrangement also operates with especially low wear.

Another advantageous embodiment of the lifting mechanism may consist of the fact that it has a pusher rod displaceably arranged in the respective channel of the profile body, so that startup elements provided for lifting the tappets and ramp elements cooperating with the former can be moved by means of these pusher rods in relation to one another. This mechanical solution to the problem has proven to be particularly stable.

The pusher rod may expediently contain the startup elements preferably designed as startup rollers and may be accommodated on casters. This yields an especially compact arrangement which is at the same time very smooth running.

In this context, another advantageous measure may consist of the fact that the profile body is designed in two parts and has an attachment having a roller surface assigned to the pusher rod, closing the channel which accommodates the pusher rod. This attachment may advantageously be made of a high grade material and/or may be hardened to obtain a high quality running surface.

Other advantageous embodiments and expedient refinements of the primary measures can be derived in greater detail from the following description of a few exemplary embodiments with reference to the drawings.

DETAILED DESCRIPTION OF THE DRAWINGS

Figure 1:
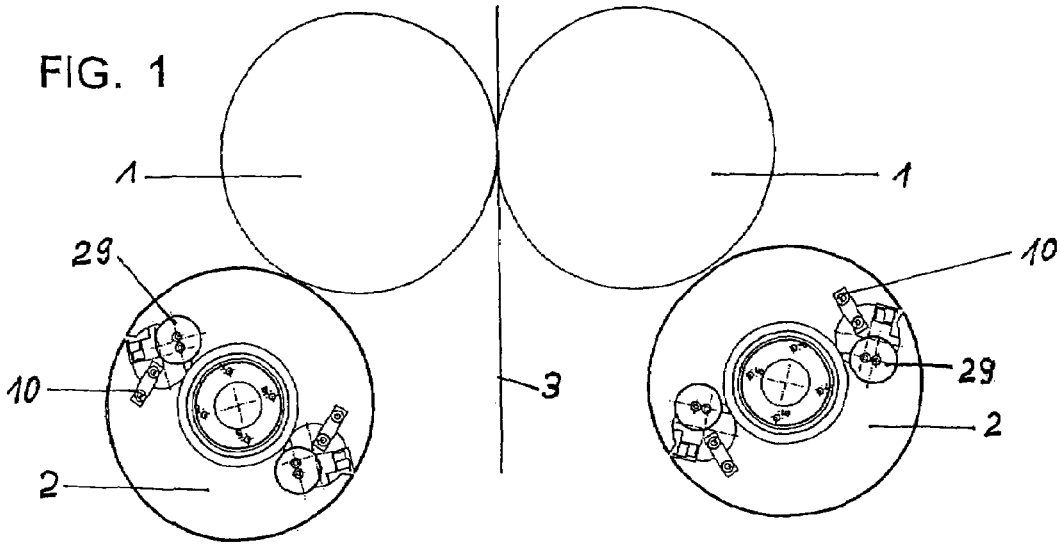
FIG. 1 is a schematic diagram of a double printing unit.

The double printing unit depicted in FIG. 1 includes two transfer cylinders 1 rolling against one another in a known way, a gravure cylinder, designed here as a plate cylinder 2 assigned to each transfer cylinder. A web 3 of print substrate is passed between the two transfer cylinders 1. The diameter of the transfer cylinder 1 and the diameter of the plate cylinder 2 are the same. With one revolution of the transfer cylinder 1, the plate cylinders 2 therefore rotate once on the respective transfer cylinder 1.

Flexible printing plates are clamped on the circumference of the plate cylinder 2. This may be done manually or by means of an automatic plate changing mechanism. The inventive device which is to be provided on the cylinder end as described below for securing the printing plates has proven to be especially advantageous in conjunction with the use of an automatic plate changing mechanism.

Several printing plates arranged side-by-side may be provided over the length of the plate cylinders 2. The circumference of the plate cylinders 2 corresponds to twice the length of the plate so that two printing plates can be clamped on the circumference. Accordingly, these plate cylinders 2 are referred to as double round plate cylinders.

Figure 2:
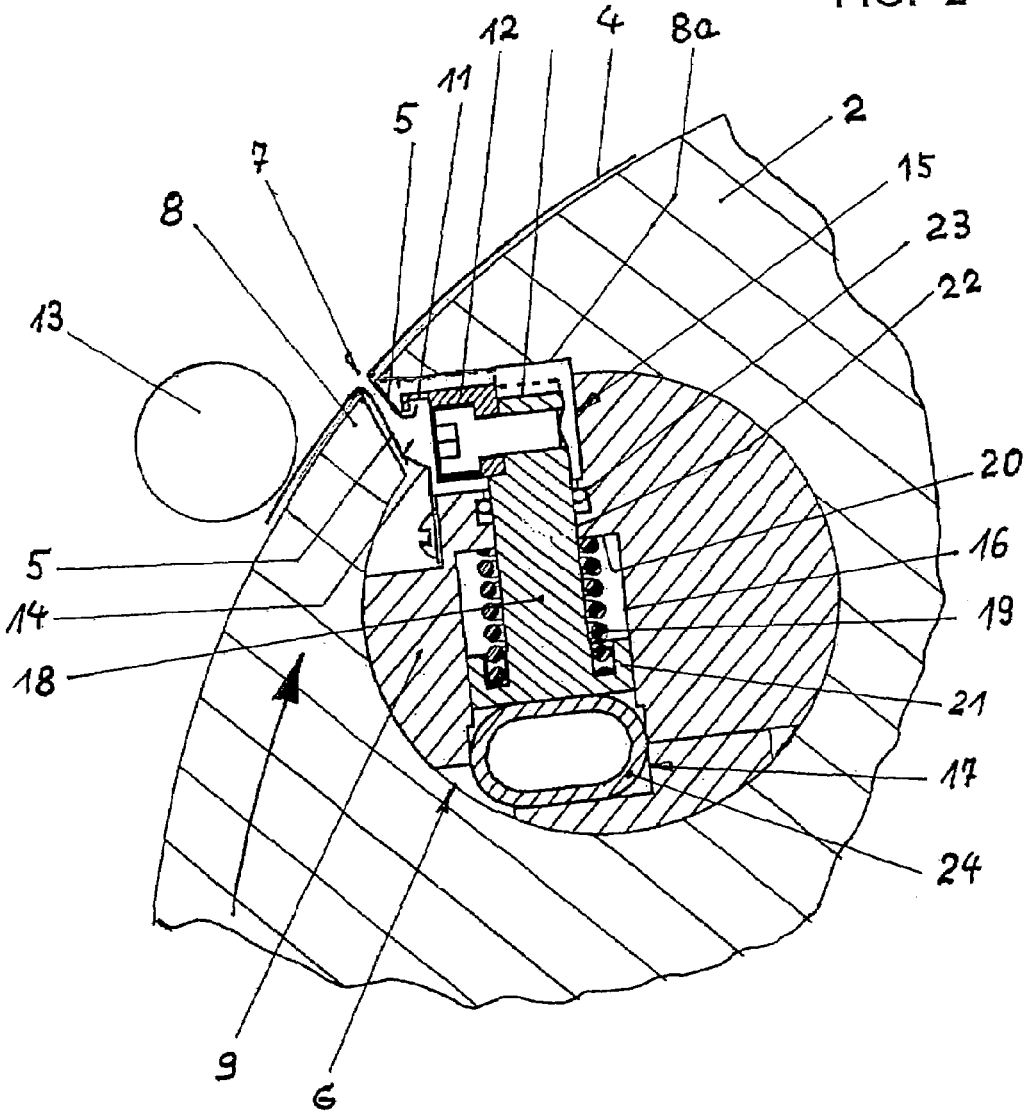
FIG. 2 is a first embodiment of the inventive device for securing the printing plates with a pneumatic lifting mechanism.

The printing plates 4 that can be accommodated on the circumference of the plate cylinders 2 are bent at their ends, as shown in FIG. 2 so as to result in front and rear suspension straps 5. These straps are brought into engagement with a securing device provided on the plate cylinder, as explained in greater detail below. Each plate cylinder 2 here has two securing mechanisms on its circumference, as shown in FIG. 1.

As also show in FIG. 2, the plate cylinders 2 each have an installation channel 6 which is formed by an axially parallel recess and is accessible through an entrance slot 7 on the circumference. To form the installation channel 6, an axially parallel borehole near the circumference is provided as a filling body, an input area tapering outward in the form of a wedge emanating from this borehole, resulting in a comparatively narrow entrance slot 7 and lip edges 8 flanking the slot. A profile body 9 manufactured from a section of round rod is situated in the bore-shaped area of the installation channel 6 and is secured on the cylinder body as indicated by a connecting strap 10 shown in FIG. 1. The diameter of the profile body 9 corresponds to the diameter of the borehole. With double round cylinders of the type shown in FIG. 1, there is a comparatively thick ring area between the bearing journal and the cylinder jacket to accommodate the arrangement outlined briefly above. Therefore, this invention is expediently used preferably with double round cylinders.

A tensioning bar 12 provided with a hanging claw 11 facing the entrance slot 7 and an actuating mechanism assigned to the latter are accommodated on the profile body 9. The actuating mechanism consists of a lifting mechanism and a return mechanism counteracting the former. It is thus possible to move the tensioning bar 12 so that it approaches the entrance slot 7 and can be moved away from it. The inner border 8*a* of the rear lip edge 8 runs at a right angle to the lifting direction of the tensioning bar 12 and thus approximately parallel to the top side of the tensioning bar 12, which is an especially space-saving measure and forms a reliable end stop for the tensioning bar 12.

The front bent ends of the printing plates 4 are suspended on a respective peak edge 8 namely in the example shown here on the lip edge 8 shown at the right. Then the printing plates 4 are applied with full coverage to the cylinder circumference. In the example shown here, a printing roll 13 is used for this purpose. To secure the front ends of the plate during this procedure, a clamping spring 14 is provided here, having a head which comes to rest against the inside flank of the wedge-shaped lip edge 8 assigned to the front plate ends. It would of course also be conceivable for the tensioning bar 12 to act on the inner flank of the lip edge 8 to accomplish the aforementioned clamping effect. However this would require a comparatively large lifting motion of the tensioning bar 12. After the printing plates 4 have been applied to the circumference of the respective plate cylinder 2, their rear ends are suspended on the respective tensioning bar 12, i.e., on its suspension claw 11. This is accomplished here by unrolling the pressure roller 13. The tensioning bar 12 is brought into an upper assembly position indicated with interrupted lines in FIG. 2 for engaging the rear ends of the printing plates 4. After engaging the rear plate ends, the tensioning bar 12 is retrieved, i.e., moved a distance back away from the entrance slot, as indicated with solid lines in the figure, thus exerting a tensioning force on the printing plates 4.

To achieve a compact design, the profile body 9 is provided with a triangular cutout 15 in the circumferential area facing the entrance slot 7, the tensioning bar 12 and the clamping spring 14 adjacent thereto optionally being situated in this triangular cutout. The clamping spring is designed as a plate spring which is accommodated and secured on a flank of the cutout 15 with a bend that forms a foot. The cutout 15 is connected to a channel 17 running continuously in the longitudinal direction of the profile body 9 opposite the cutout 15 through boreholes 16 running in the direction of movement of the tensioning bar 12. The lifting mechanism assigned to the tensioning bar 12 is situated in this channel.

Tappets 18 passing the boreholes 16 are mounted on the tensioning bar 12 and cooperate at their end facing away from tensioning bar 12 with the lifting mechanism mentioned above, to be described in greater detail below. Due to the lifting mechanism, the tappets 18 and with them the tensioning bar 12 can be brought into proximity of the entrance slot 7. For returning to a position set back from this, a return mechanism is provided. This is formed here by springs 19 which reach around the tappets 18 and are supported on a shoulder 20 near the bore at one end and on a spring plate 21 mounted on the lower end of the tappet 18 at the other end. To form the shoulders 20, the bores 16 are designed as step bores having an expanded lower area assigned to the springs 19. Above the shoulders 20, the wall of the bore 16 forms a guide area 22 assigned to the respective tappet 18. The guide area may include a sealing mechanism 23 which seals the guide gap. In this way the aggregates beneath the gap in the form of the springs 19 which function as the return mechanism and the lifting mechanism arranged in the channel 17 are sealed with respect to the input area of the installation space 6 and thus protected from soiling. At the same time, accommodating this in the profile body 9 ensures reliable impact protection and engagement protection.

In the embodiment according to FIG. 2, the above mentioned lifting mechanism is designed as a lifting pad 24 which is acted upon by a pressure means and cooperates with the underside of the spring plate 21. This lifting pad may be provided with connections for lines for supplying and removing media accessible in the area of a cylinder end face but not shown in greater detail here.

Preferably compressed air is used as the pressure means which is easily obtainable from the compressed air system available in any printing shop. The lifting movement accomplished by the pressure means acting on the lift cushion 24 is expediently limited by a stop mechanism. In this example shown here, the spring plates 21 arranged in the channel 17 function as stops. The diameter of the spring plates here is greater than the diameter of the lower section of the borehole 16 designed as a step bore. The lifting motion acts against the force of the springs 19. As soon as the pressure on the lifting cushion 24 is released, the springs 19 accomplish a movement of the tensioning bar 12 leading away from the entrance slot 7, so that a tensile force is exerted on the rear plate ends suspended on the tensioning bar.

Figure 3:
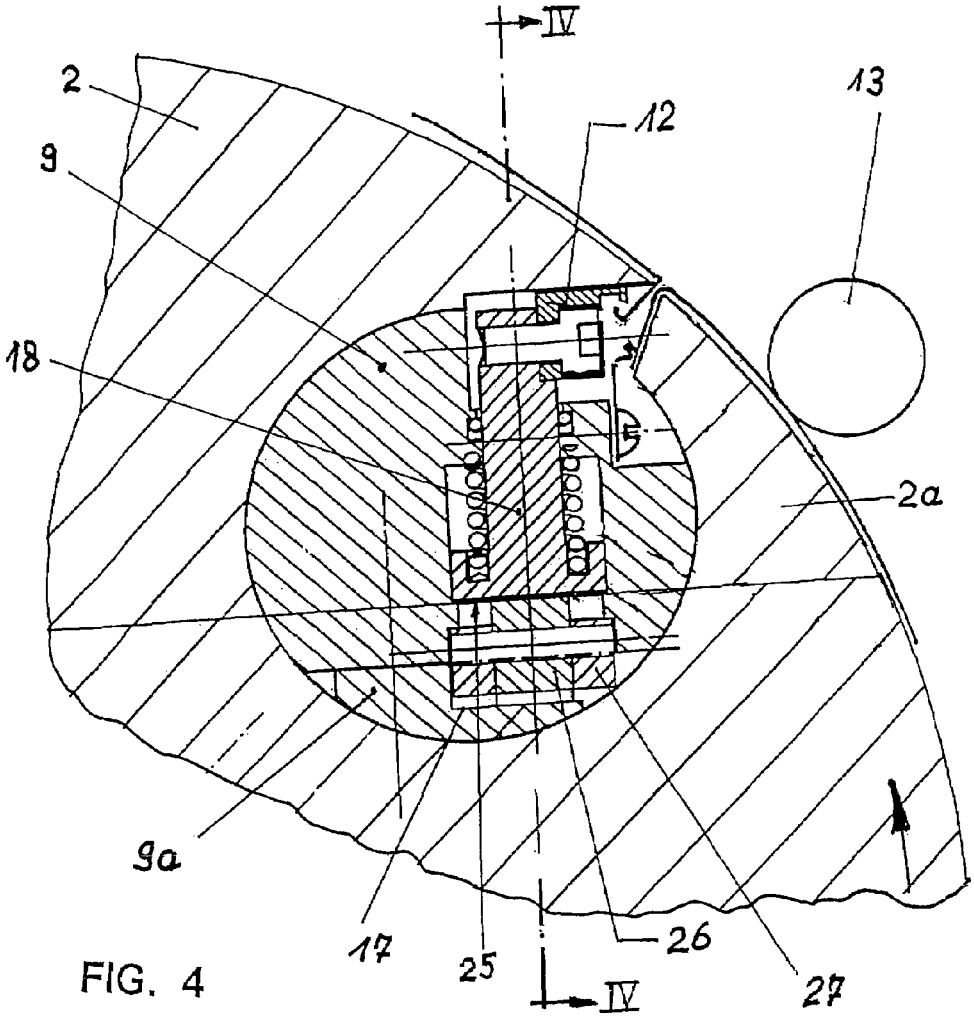
FIG. 3 is a variant of FIG. 2 with a mechanical lifting mechanism.

The embodiment according to FIG. 3 differs from the embodiment according to FIG. 2 as described above essentially only in the design of the lifting mechanism provided for the tensioning bar 12. It is designed here as a mechanical lifting mechanism. To this end, a ramp face 25 having a skewed plane and startup elements 26 that cooperate with it are provided. To achieve a lifting motion, the startup elements 26 and the ramp faces 25 are moved in relation to one another. The relative movement is accomplished by means of a pusher rod 27 displaceably guided in the axial direction in the channel 17 of the profile body 9 assigned to the lifting mechanism.

Figure 4:
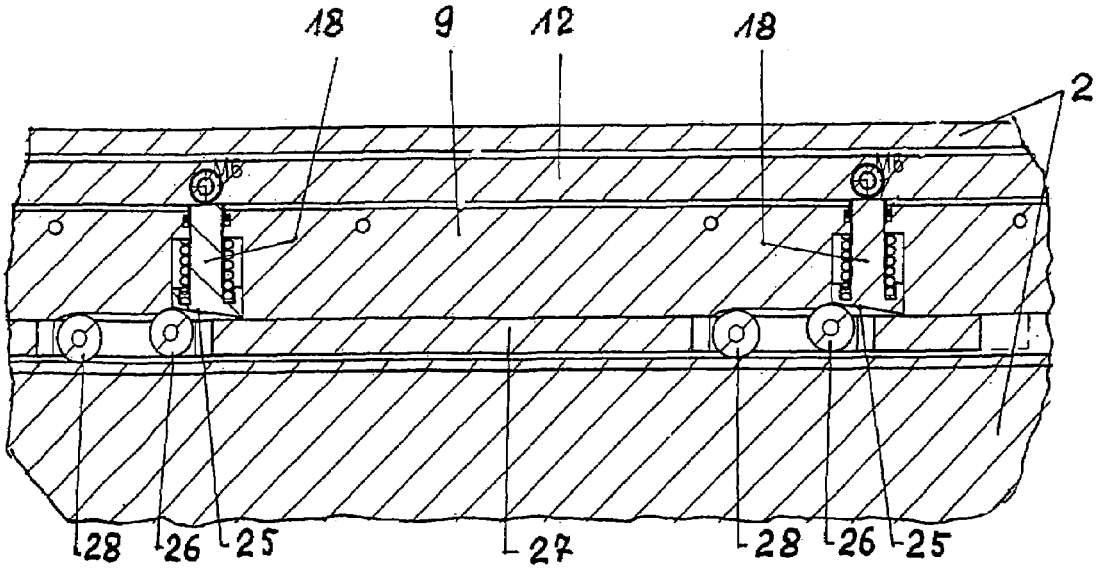
FIG. 4 is a section along line IV/IV in FIG. 3.

In the exemplary embodiment shown here, the ramp faces 25 are brought into contact with the underside of the tappets 18. The pusher rod 27 has the startup elements which are assigned to the ramp faces 25 and are designed here as startup rollers 26, as shown best in FIG. 4. The startup rollers 26 may engage deeply in the pusher rod 27, which greatly facilitates achieving a compact arrangement. The pusher rod may be designed as a sliding element. In the example shown here the pusher rod is equipped with casters 28, which yields a smooth running arrangement.

The pusher rod 27 runs here with its casters 28 on a respective running surface of the profile body 9. This surface is expediently hardened. To facilitate this, the profile body 9 is divided into two parts here. The joint between the parts is situated in the area of the channel 17 assigned to the lifting mechanism, resulting in a block piece 9*a* which closes the channel 17 and includes the aforementioned running face, the piece being made of a suitable running surface material and optionally hardened at least in the area of the running surface, preferably over the entire part. To facilitate the machining, the border of the installation channel 6 containing the front lip edge 8 may also be designed as an attachment piece 2*a* to be attached subsequently.

For operation of the pusher rod 27, it may have an actuating device which is provided in the area of an end face of the plate cylinder 2 assigned to it, e.g., in the form of a pneumatic and/or hydraulic cylinder unit, indicated as 29 in FIG. 1.

The installation channel 6 expediently runs over the entire length of the respective plate cylinder 2. The profile body 9 may likewise be continuous. Two profile bodies 9 may advantageously also be provided, these bodies being insertable into the installation channel 6 from different cylinder end faces, each being assigned to half of the cylinder length. The same thing is true of the tensioning bars 12. Accordingly a tensioning bar 12 of the same length is accommodated on each profile body 9, the tensioning bar expediently having two tappets 18 spaced a distance apart, a common lifting mechanism being assigned to both. Accordingly, the lifting cushion 24 and/or the pusher rod 27 each extends over all the tappets 18 of a tensioning bar 12. The lifting mechanisms integrated into the two profile bodies 9 are each accessible from the opposite cylinder ends.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A plate cylinder for a web-fed printing press, having a device for securing flexible printing plates provided with bent ends and mountable on a circumference of the plate cylinder, wherein an installation channel that extends parallel to an axis of the cylinder and that is accessible through an entrance slot on the circumference is provided, and bordered on one side of an input area by a wedge-shaped lip edge for suspending a front end of the plates wherein at least one profile body manufactured from a section of a round rod is secured into an axially parallel extending bore-shaped area of the installation channel and includes at least one mounting mechanism that is engageable with a rear end of at least one printing plate, wherein the mounting mechanism includes a tensioning bar that is accommodated on the profile body and is moveable toward and away from the entrance slot, and includes an actuating device installed into the profile body and assigned to the tensioning bar, wherein the actuating device consists of a lifting mechanism and a return mechanism counteracting the lifting mechanism, wherein the tensioning bar is suspendable by the lifting mechanism in an assembly position which approaches the entrance slot and in which the rear end of the plate is suspendable on a suspension claw on an end of the tensioning bar and wherein the tensioning bar is tensionally engageable with the rear end of the plate by the return mechanism.

2. The plate cylinder according to claim 1, wherein at least one clamping spring adjacent to the tensioning bar is situated on the profile body, coming to rest on an inside flank of the wedge-shaped lip edge assigned to the front end of the plates.

3. The plate cylinder according to claim 2, wherein the profile body has a cutout assigned to the tensioning bar in a circumferential area facing the entrance slot.

4. The plate cylinder according to claim 3, wherein the at least one clamping spring is a plate spring which is secured with a foot strip on a flank of the cutout.

5. The plate cylinder according to claim 1, wherein the profile body has a channel facing the lifting mechanism, boreholes emanating from the channel, and tappets that carry the tensioning bar and cooperate with the lifting mechanism and the return mechanism engaging in these boreholes.

6. The plate cylinder according to claim 5, wherein the boreholes connect a cutout of the profile body to the channel.

7. The plate cylinder according to claim 5, wherein the tappets are guided in respective boreholes.

8. The plate cylinder according to claim 5, wherein a sealing mechanism cooperates with a respective tappet in an area of a respective borehole.

9. The plate cylinder according to claim 5, wherein the return mechanism is formed by springs extending around the tappets and supported at one end on a shoulder near a respective borehole and at another end on a spring plate mounted on a respective tappet.

10. The plate cylinder according to claim 5, wherein the lifting mechanism assigned to the tappets is a lifting unit which is acted upon by a pressure means.

11. The plate cylinder according to claim 10, wherein the lifting mechanism is a lifting pad which reaches beneath the tappets.

12. The plate cylinder according to claim 5, wherein the lifting mechanism is a mechanical unit which has ramp faces that are moveable in relation to one another and startup elements which cooperate with the ramp faces.

13. The plate cylinder according to claim 12, wherein the lifting mechanism has a pusher rod displaceably arranged in a respective channel of the profile body by means of which the startup elements and the ramp faces are moveable in relation to one another.

14. The plate cylinder according to claim 13, wherein the startup elements are startup rollers and are arranged on the pusher rod and the ramp faces are connected to the tappets.

15. The plate cylinder according to claim 13, wherein the pusher rod is provided with casters.

16. The plate cylinder according to claim 13, wherein at least a running surface of the channel facing the pusher rod is hardened.

17. The plate cylinder according to claim 13, wherein the profile body includes multiple parts and has an attachment piece that includes a running surface of the channel facing the pusher rod and closes the channel.

18. The plate cylinder according to claim 13, wherein the pusher rod is operable by means of a lifting cylinder unit situated in an area of an end face of the cylinder.

19. The plate cylinder according to claim 1, wherein the installation channel passes through an entire length of the cylinder.

20. The plate cylinder according to claim 1, wherein at least two profile bodies are provided over an entire length of the cylinder, each having a tensioning bar and an actuating mechanism assigned to it.

21. The plate cylinder according to claim 1, wherein a pressure mechanism which is rollable on the circumference of the cylinder is provided.

22. The plate cylinder according to claim 1, wherein the printing plate is applied to the cylinder by a machine.

23. The plate cylinder according to claim 1, wherein the cylinder is a double round cylinder.

24. A plate cylinder for a web-fed printing press, comprising:

a channel defined by the cylinder and extending parallel to an axis of the cylinder, wherein the channel is accessible through an entrance slot defined by an outer circumferential edge of the cylinder;

a profile body manufactured from a section of a round rod and disposed within a bore-shaped area of the channel extending parallel to the axis of the cylinder; and a mounting mechanism including:

a tensioning bar disposed on the profile body and moveable toward and away from the entrance slot; and an actuating device disposed into the profile body and operably connected to the tensioning bar, wherein the actuating device includes a lifting mechanism and a return mechanism;

wherein the lifting mechanism moves the tensioning bar toward the entrance slot and wherein the return mechanism moves the tensioning bar away from the entrance slot.

25. A method for securing a printing plate on a plate cylinder of a web-fed printing press, comprising the steps of:

moving a tensioning bar by an actuating device toward an entrance slot defined by an outer circumferential edge of the cylinder to engage a rear end of the printing plate, wherein the tensioning bar is disposed on a profile body manufactured from a section of a round rod and disposed within a bore-shaped area of a channel defined by the cylinder and extending parallel to an axis of the cylinder, and wherein the actuating device is disposed into the profile body; and after engaging the rear end of the printing plate, moving the tensioning bar away from the entrance slot by the actuating device to exert a tensioning force on the rear end of the printing plate.

* * * * *